US006308608B1

(12) United States Patent
Eisenman

(10) Patent No.: US 6,308,608 B1
(45) Date of Patent: Oct. 30, 2001

(54) DUST SUPPRESSION

(76) Inventor: Moshe Eisenman, 22B HaRav Bloch, Kiryat Telz Stone, M.P. Harei Yehuda 90838 (IL)

( * ) Notice: Subject to any disclaimer, the term of this patent is extended or adjusted under 35 U.S.C. 154(b) by 0 days.

(21) Appl. No.: 09/373,525

(22) Filed: Aug. 12, 1999

(30) Foreign Application Priority Data

Aug. 30, 1998 (IL) ..... 125989

(51) Int. Cl.[7] ..... F41A 21/00
(52) U.S. Cl. ..... 89/14.3; 89/14.2
(58) Field of Search ..... 89/14.3, 14.2; 42/1.06

(56) References Cited

U.S. PATENT DOCUMENTS

| | | | | |
|---|---|---|---|---|
| 4,429,614 | | 2/1984 | Tocco | 89/14 C |
| 4,545,285 | | 10/1985 | McLain | 89/14.3 |
| 4,852,460 | * | 8/1989 | Davidson | 89/14.3 |
| 5,092,223 | | 3/1992 | Hudson | 89/14.2 |
| 5,357,842 | | 10/1994 | Reynolds | 89/14.3 |
| 5,367,940 | | 11/1994 | Taylor | 89/14.3 |
| 5,385,079 | | 1/1995 | Cave | 89/14.3 |
| 5,425,298 | | 6/1995 | Coburn | 89/14.3 |
| 5,811,714 | * | 9/1998 | Hull et al. | 89/14.3 |
| 5,814,757 | * | 9/1998 | Buss | 89/14.3 |

FOREIGN PATENT DOCUMENTS

| | | | |
|---|---|---|---|
| 3206642 | 2/1982 | (DE) | F41F/17/12 |
| 3701710 | 1/1987 | (DE) . | |
| 3831766 | 9/1988 | (DE) | F41A/21/36 |
| 4100710 | 7/1991 | (DE) | F41A/21/36 |
| 0 723 131 | 7/1996 | (EP) | F41A/21/36 |
| 2693547 | 1/1994 | (FR) | F41A/21/36 |
| WO 94/15164 | 7/1994 | (WO) | F41A/2/36 |

* cited by examiner

*Primary Examiner*—J. Woodrow Eldred
(74) *Attorney, Agent, or Firm*—Abelman, Frayne & Schwab

(57) ABSTRACT

A method for suppressing raising of dust as a result of firing a projectile from a barrel of a weapon, wherein the dust is raised by a shock wave exiting the barrel, the method comprising reducing an exit pressure of gases of an explosive charge exiting the barrel. There is also disclosed a weapon including a barrel with a barrel bore formed therethrough, the barrel bore having a longitudinal axis, and a barrel extension element extending from and in fluid communication with the barrel bore, the barrel extension element having a barrel extension bore formed therethrough, wherein a plurality of gas exit holes are formed on sides of the barrel extension element, the gas exit holes being non-symmetrical with respect to a horizontal plane which passes through the longitudinal axis.

14 Claims, 1 Drawing Sheet

DUST SUPPRESSION

FIELD OF THE INVENTION

This invention relates generally to land warfare and projectiles fired by artillery, tanks, etc., and more particularly to apparatus and methods for reducing or eliminating the large amounts of dust raised by firing such projectiles.

BACKGROUND OF THE INVENTION

Presently there are only tactical solutions to the obstruction of soldiers' views by dust raised by the firing of projectiles. For example, in the case of tanks, present tactical methods may require tanks to work in teams of two. This ensures that when one tank fires and becomes temporarily "blinded" by the raised dust from the firing of the projectile, the second tank is not allowed to fire so that its crew can act as "spotters" to provide retargeting information to the tank that fired.

Among the disadvantages of the prior art method is that at any given moment, a percentage of a combat force is not free to fire weapons so that they may maintain an unobstructed view. Retargeting information is less accurate when it comes from a different location than the firing weapon due to parallax. Moreover, during the daytime, dust raised by firing a projectile gives away the location of a hidden weapon to the enemy. The flatter the trajectory of the fired projectile the closer the barrel of the weapon will be to the ground, and, therefore, the more dust will be raised. This problem is exacerbated when a tank or cannon is hidden "hull down" behind a small hill or embankment.

SUMMARY OF THE INVENTION

The mechanism by which dust is raised by the firing of a projectile is as follows: There are two ball-shaped shock waves that exit the barrel when a projectile is fired. The first shock wave is created as the air in the barrel is compressed by the front of the projectile as it travels hypersonically down the barrel. The second shock wave is created by the gases of the explosive charge that push the projectile out of the barrel. Both shock waves are believed to contribute to the problem of raising dust. However, the effect of the second shock wave is more intense than the effect of the first. The present invention provides a novel structure which deals with the effects of these two shock waves.

When high pressure gases exit the barrel, a generally spherical shock wave expands in all directions and parts of this "sphere" impact the ground and raise dust. The solution of the present invention is to reduce the pressure of the gases at the exit point of the barrel, thus weakening the shock waves' abilities to raise dust.

Throughout the specification the terms gun and weapon are used interchangeably.

There is thus provided in accordance with a preferred embodiment of the present invention a method for suppressing raising of dust as a result of firing a projectile from a barrel of a weapon, wherein the dust is raised by a shock wave exiting the barrel, the method comprising reducing an exit pressure of gases of an explosive charge exiting the barrel.

In accordance with a preferred embodiment of the present invention the reducing of the pressure is accomplished by releasing gas at sides of a barrel extension element that extends from an end of the barrel. This is preferably accomplished by forming at least one gas exit hole on a side of the barrel extension element.

There is thus provided in accordance with a preferred embodiment of the present invention a weapon including a barrel with a barrel bore formed therethrough, the barrel bore having a longitudinal axis, and a barrel extension element extending from and in fluid communication with the barrel bore, the barrel extension element having a barrel extension bore formed therethrough, wherein a plurality of gas exit holes are formed on sides of the barrel extension element, the gas exit holes being non-symmetrical with respect to a horizontal plane which passes through the longitudinal axis.

Further in accordance with a preferred embodiment of the present invention a plurality of gas exit holes are formed on sides of the barrel extension element, the holes being symmetrically formed with respect to a vertical plane which passes through the longitudinal axis.

Still further in accordance with a preferred embodiment of the present invention the at least one gas exit hole is angled upwards relative to a horizontal plane which passes through the longitudinal axis.

Additionally in accordance with a preferred embodiment of the present invention the at least one gas exit hole is formed above the longitudinal axis.

Further in accordance with a preferred embodiment of the present invention possible damage to the barrel is avoided by making a gas pressure at a bottom portion of a bore of the barrel extension element smaller than a gas pressure at a top portion of the bore of the barrel extension element.

There is also provided in accordance with a preferred embodiment of the present invention a weapon including a barrel with a barrel bore formed therethrough, the barrel bore having a longitudinal axis, and a barrel extension element extending from and in fluid communication with the barrel bore, the barrel extension element having a barrel extension bore formed therethrough, wherein "$c_T$" is defined as a clearance between the bore and the barrel extension bore at a top point where the barrel extension element extends from the barrel bore, "$\alpha_T$" is defined as an angle between the barrel extension bore and the longitudinal axis at a top portion of the barrel extension, "$c_B$" is defined as a clearance between the barrel bore and the barrel extension bore at a bottom point where the barrel extension element extends from the barrel bore, "$\alpha_B$" is defined as an angle between the barrel extension bore and the longitudinal axis at a bottom portion of the barrel extension, and wherein at least one of two conditions is met: $c_B > c_T$ and $\alpha_B > \alpha_T$.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
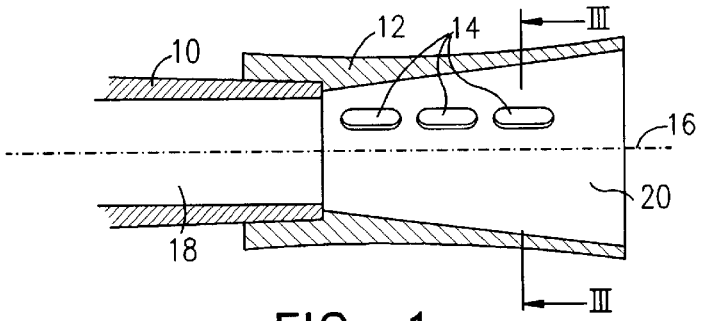
FIG. 1 is a simplified sectional illustration of a weapon barrel and barrel extension element constructed and operative in accordance with a preferred embodiment of the present invention.
Figure 2:
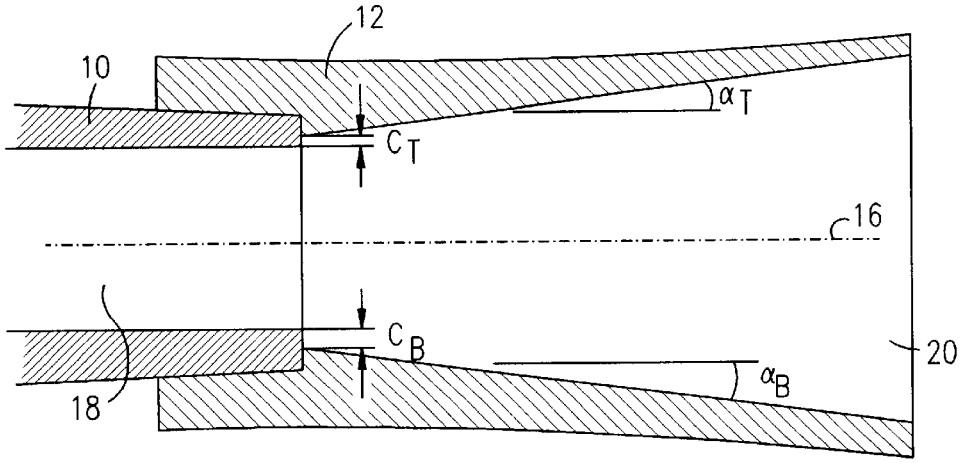
FIG. 2 is an enlarged illustration of the barrel extension of FIG. 1.
Figure 3:
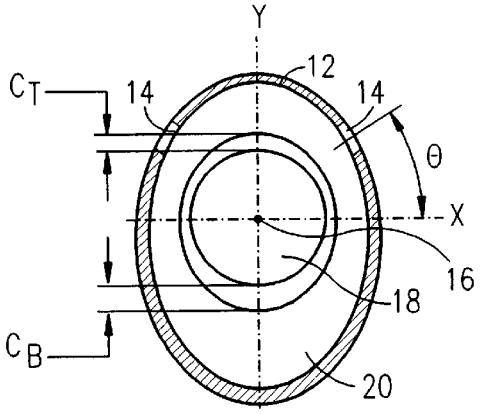
FIG. 3 is a simplified sectional illustration of the barrel extension element of FIG. 1, taken along lines III—III in FIG. 1.

Reference is now made to FIGS. 1–3 which illustrate a weapon barrel 10 and barrel extension element 12 constructed and operative in accordance with a preferred embodiment of the present invention. Barrel extension element 12 may be manufactured separately from weapon barrel 10, or alternatively may be manufactured together therewith. As a further alternative, barrel extension element 12 may be fashioned by modifying the shape of an existing barrel 10. The structure of the present invention reduces the pressure of the gases at the exit of barrel extension element 12, as is now described.

One or more gas exit holes 14 are formed on the sides of barrel extension element 12, through which some of the exit gases escape, thereby reducing the gas pressure at the exit of the barrel. When the ratio of the area of holes 14 at the sides of barrel extension element 12 is large enough relative to the area of the exit of barrel extension element 12, then the gas pressure at the exit will be small enough so that little or no dust is raised.

The side exit holes 14 can possibly contribute to the raising of dust on both sides of barrel 10. Therefore, gas exit holes 14 are preferably formed above a longitudinal axis 16 of a longitudinal bore 18 of barrel 10. Additionally or alternatively, gas exit holes 14 are angled upwards at an angle θ relative to a horizontal plane X which passes through axis 16. In this manner, shock waves are directed upwards relative to the ground. The upwardly directed shock waves create an enormous downward impact on barrel 10 which could damage or break barrel 10. To avoid this, a bore 20 of barrel extension element 12 through which the projectile passes is designed in a way to create an upward impact force which opposes, and therefore, greatly reduces, or even cancels the downward impact (force) created by side gas exit holes 14.

The way to create an upward impact force on barrel extension element 12 that reduces or cancels the downward force created by holes 14, is preferably by shaping barrel extension bore 20 in such a way as to cause the pressure in the top of bore 20 to be greater than the pressure in the bottom of bore 20. A preferred way of doing this is as follows:

Four parameters are important in the design of the shape of bore 20, as seen particularly in FIG. 2:

"$c_T$"—is the clearance between barrel bore 18 and barrel extension bore 20 at the top point where they meet.

"$\alpha_T$"—is the angle between barrel extension bore 20 and axis 16 (axis 16 being the gun bore axis of symmetry), at the top of barrel extension element 12.

"$c_B$"—is the clearance between barrel bore 18 and barrel extension bore 20 at the bottom point where they meet.

"$\alpha_B$"—is the angle between barrel extension bore 20 and axis 16 (axis 16 being the gun bore axis of symmetry), at the bottom of barrel extension element 12.

By selecting $c_B > c_T$ and/or $\alpha_B > \alpha_T$ the pressure at the top of barrel extension element 12 is greater than the pressure at the bottom of barrel extension element 12, and the desired upward impact force is achieved, thus reducing or canceling the downward impact force of the side gas exit holes 14. Preferably, although not necessarily, holes 14 are symmetrically formed with respect to a vertical plane Y which passes through longitudinal axis 16.

The mathematical evaluation of the above design parameters is very difficult due to the complexity of modeling the interaction between shock waves and dust. Accordingly, the parameters should be evaluated experimentally. The total number of rounds that would have to be fired in order to evaluate the design parameters should not exceed a few dozen.

An example of the design parameters is as follows: The length of barrel extension element (whether manufactured separately or a modified part of barrel 10) is approximately 50 cm. The ratio between the area of the side holes 14 and the exit area is approximately 1. The angular elevation of holes 14 above the horizontal plane X is less than 60°. Angles $\alpha_T$ and $\alpha_B$ are preferably less than 5°, such as 2° and 4°, respectively, for example. Clearances $C_T$ and $C_B$ are preferably no greater than 1 cm, such as 0 and 6 mm, respectively, for example.

In accordance with a preferred embodiment of the present invention, $C_B$, $C_T$, $\alpha_B$ and $\alpha_T$ are selected such that a small net downward impact force is nevertheless maintained to attenuate the natural upward kick of the barrel as a result of firing a round through it.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A weapon comprising:

a barrel with a barrel bore formed therethrough, said barrel bore having a longitudinal axis; and a barrel extension element extending from and in fluid communication with said barrel bore, said barrel extension element having a barrel extension bore formed therethrough, wherein a plurality of gas exit holes are formed on sides of said barrel extension clement, said gas exit holes being non-symmetrical with respect to a horizontal plane which passes through the longitudinal axis, wherein said barrel extension bore is shaped to cause a gas pressure at a bottom portion of the barrel extension bore to be smaller than a gas pressure at a top portion of the barrel extension bore.

2. The weapon according to claim 1 wherein said gas exit holes are angled upwards relative to the horizontal plane which passes through the longitudinal axis.

3. The weapon according to claim 1 wherein said gas exit holes are formed above the longitudinal axis.

4. The weapon according to claim 1 wherein said gas exit holes are symmetrically formed with respect to a vertical plane which passes through the longitudinal axis.

5. A weapon comprising:

a barrel with a barrel bore formed therethrough, said barrel bore having a longitudinal axis; and a barrel extension element extending from and in fluid communication with said barrel bore, said barrel extension element having a barrel extension bore formed therethrough, wherein a plurality of gas exit holes are formed on sides of said barrel extension element, said gas exit holes being non-symmetrical with respect to a horizontal plane which passes through the longitudinal axis, wherein:

"$c_T$" is defined as a clearance between said bore and said barrel extension bore at a top point where said barrel extension element extends from said barrel bore;

"$\alpha_T$" is defined as an angle between the barrel extension bore and the longitudinal axis at a top portion of the barrel extension;

"$c_B$" is defined as a clearance between the barrel bore and the barrel extension bore at a bottom point where said barrel extension element extends from said barrel bore;

"$\alpha_B$" is defined as an angle between the barrel extension bore and the longitudinal axis at a bottom portion of the barrel extension;

and wherein at least one of two conditions is met: $c_B > c_T$ and $\alpha_B > \alpha_T$.

6. A weapon comprising:

a barrel with a barrel bore formed therethrough, said barrel bore having a longitudinal axis; and a barrel extension element extending from and in fluid communication with said barrel bore, said barrel extension element having a barrel extension bore formed therethrough, wherein "$c_T$" is defined as a clearance between said bore and said barrel extension bore at a top point where said barrel extension element extends from said barrel bore;

"$\alpha_T$" is defined as an angle between the barrel extension bore and the longitudinal axis at a top portion of the barrel extension;

"$c_B$" is defined as a clearance between the barrel bore and the barrel extension bore at a bottom point where said barrel extension element extends from said barrel bore;

"$\alpha_B$" is defined as an angle between the barrel extension bore and the longitudinal axis at a bottom portion of the barrel extension;

and wherein at least one of two conditions is met: $c_B > c_T$ and $\alpha_B > \alpha_T$.

7. The weapon according to claim 6 wherein at least one gas exit hole is formed on a side of said barrel extension element.

8. The weapon according to claim 7 wherein said at least one gas exit hole is angled upwards relative to a horizontal plane which passes through the longitudinal axis.

9. The weapon according to claim 7 wherein said at least one gas exit hole is formed above the longitudinal axis.

10. The weapon according to claim 6 wherein a plurality of gas exit holes are formed on sides of said barrel extension element, said holes being symmetrically formed with respect to a vertical plane which passes through the longitudinal axis.

11. The weapon according to claim 6 wherein said barrel extension bore is shaped to cause a gas pressure at a bottom portion of the barrel extension bore to be smaller than a gas pressure at a top portion of the barrel extension bore.

12. A method for suppressing raising of dust as a result of firing a projectile from a barrel of a weapon, wherein the dust is raised by a shock wave exiting the barrel, the method comprising reducing an exit pressure of gases of an explosive charge exiting said barrel and further comprising creating an upward impact force by making a gas pressure at a bottom portion of a bore of the barrel extension element smaller than a gas pressure at a top portion of the bore of the barrel extension element.

13. The method according to claim 12 wherein said reducing comprises releasing gas at sides of a barrel extension element that extends from an end of said barrel.

14. The method according to claim 12 and further comprising shaping the barrel extension element and the barrel so as to create a downward impact force to attenuate a natural upward kick of the barrel as a result of firing a round through the barrel.

* * * * *